United States Patent [19]

Hazard et al.

[11] 4,225,305

[45] Sep. 30, 1980

[54] COMBUSTION HEAD FOR A COMBUSTION CHAMBER

[75] Inventors: Herbert R. Hazard, Columbus, Ohio; Vincenzo Recchi, Bari, Italy

[73] Assignee: Pietro Fascione, Milan, Italy

[21] Appl. No.: 967,005

[22] Filed: Dec. 6, 1978

[30] Foreign Application Priority Data

Dec. 23, 1977 [CH] Switzerland ..... 15974/77

[51] Int. Cl.[3] ..... H01M 2/08

[52] U.S. Cl. ..... 431/182; 431/188; 431/353; 60/39.82 R

[58] Field of Search ..... 431/182, 183, 184, 187, 431/188, 353, 265; 60/39.82 R

[56] References Cited

U.S. PATENT DOCUMENTS

| | | | |
|---|---|---|---|
| 2,242,797 | 5/1941 | Lucke | 431/184 X |
| 2,606,604 | 8/1952 | Whiterell | 431/353 |
| 3,570,242 | 3/1971 | Leonardi et al. | 431/183 X |
| 3,648,457 | 3/1972 | Bobo | 431/183 X |
| 3,749,548 | 7/1973 | Zink et al. | 431/183 X |
| 4,014,639 | 3/1977 | Froehlich | 431/353 |
| 4,018,554 | 4/1977 | Teodorescu et al. | 431/188 X |
| 4,082,495 | 4/1978 | Lefebvre | 431/183 |

*Primary Examiner*—Joseph Man-Fu Moy
*Attorney, Agent, or Firm*—Karl F. Ross

[57] ABSTRACT

A combustion head for a fluid fuel, particularly a liquid fuel, which is burnt particularly in the presence of a gas having an oxygen concentration substantially less than that of air, comprises, adjacent to the actual burner, a generally cylindrical box containing an inlet aperture designed to create a substantial pressure drop on injecting the oxygen-containing gas into the box, and a disc situated at the outlet of the box and dimensioned to create a second and lower pressure drop. The intense combustion produced in the box heats its walls to a temperature substantially above the final point of the distillation curve for the fuel, so preventing coke deposition.

3 Claims, 1 Drawing Figure

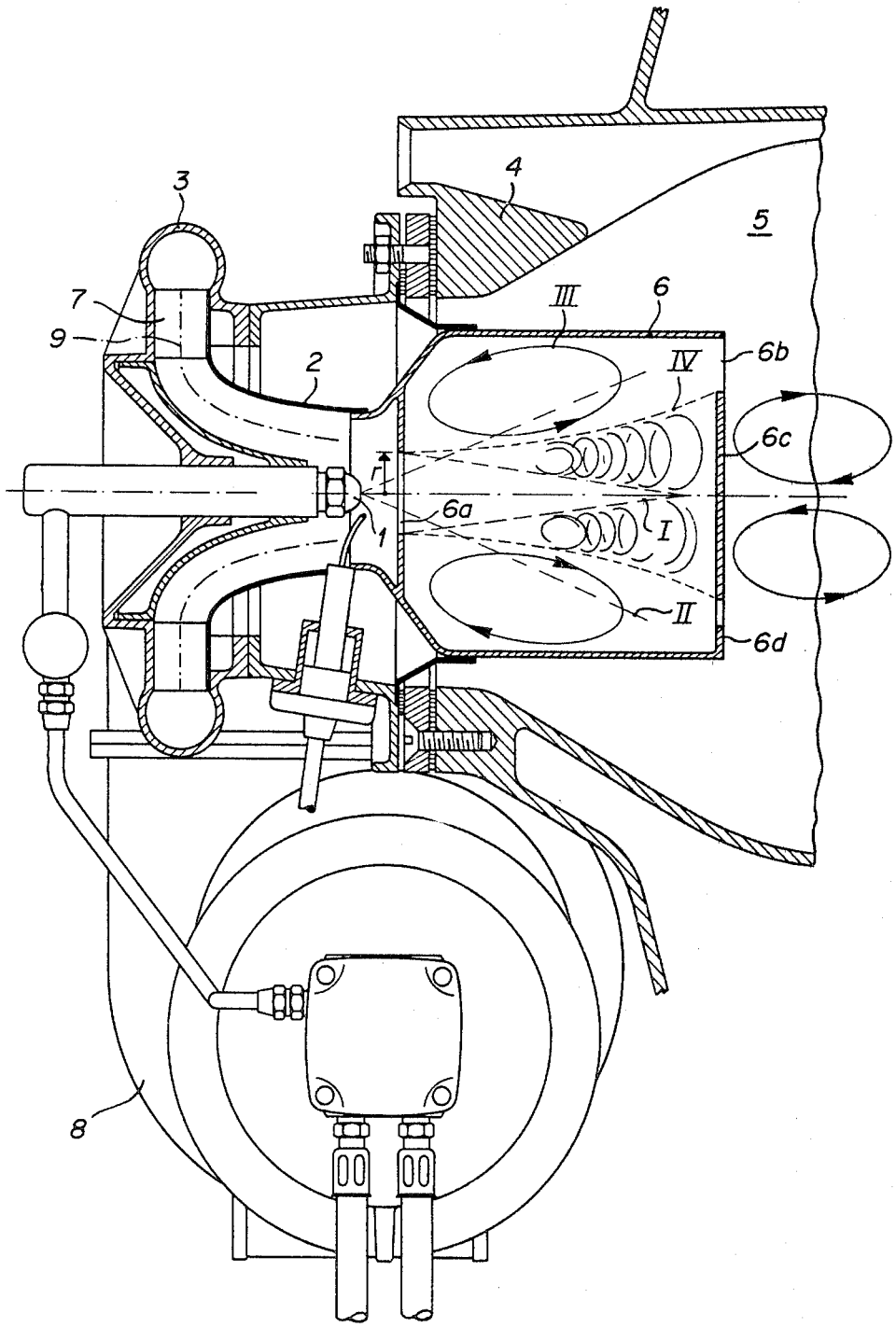
3
4
5
7
9
2
III
6
IV
6b
6c
r
6a
1
I
II
6d
8

COMBUSTION HEAD FOR A COMBUSTION CHAMBER

The advantages of combustion using as the oxygen-containing gas a certain proportion of the combustion product gas mixed with air are well known. This recirculation enables the mass flow of the combustion product gas to be increased, while fixing the excess air quantity at a very low level. Dilution of the necessary oxygen in a very large mass of gas lowers the flame temperature. This type of combustion enables the production of $NO_x$ and soot to be reduced. The increase in the mass flow of the gas due to recirculation of the combustion product gas enables the heat-transfer efficiency to be increased and the mass flow to the stack to be reduced.

On the other hand, the flame resulting from the combustion of a combustible fluid in the presence of a gas of which the oxygen concentration is substantially less than that of air becomes much less stable. To remedy this defect, it has been proposed to induce a strong turbulent movement in the oxygen-containing gas as it is introduced. The amount of turbulent movement necessary to stabilize the flame is greater, the lower the oxygen concentration. In this manner, the liquid fuel atomized into this turbulent flow is subjected to centrifugal force, such that the fuel droplets are thrown against the combustion chamber wall. As the temperature of this wall is less than the final distillation temperature of the atomized fuel, a coke and soot deposit form at the burner outlet.

Burners for fluid fuels exist in which the burner outlet opens into a flame box disposed in the combustion chamber. The purpose of such flame boxes is to prevent contact between the fuel and the externally cooled combustion chamber walls, and to limit the essential part of the combustion process to a small space in which the temperature can attain a higher level. This is notably the case in U.S. Pat. Nos. 3,319,692, 2,606,604 and 4,014,639, and in the German Publication No. 2,250,766, in which the flame-box wall is of metal, whereas in the U.S. Pat. No. 2,806,517 and French Pat. No. 2,226,056 the flame boxes are of refractory material.

Apart from U.S. Pat. Nos. 2,606,604 and 3,319,692, all these documents propose to increase the retention time of the oxygen-containing gas and fuel mixture in the flame box, by inducing in it a turbulent movement which is sufficiently large to generate at its r-center a suction which gives rise to a toroidal vortex which thus increases the length of the path of the gas mixture in the flame box. However, as already stated, this strong turbulent movement throws atomized fuel droplets against the walls of the flame box. In addition, the internal recirculation induced by the annular vortex generated by the turbulence of the oxygen-containing gas brings the cold gas fed to the box into direct contact with the wall of the flame box, so cooling it. Because of this, its temperature is reduced and complete combustion of the fuel thrown against its surface is prevented, so that these fuel residues form a coke deposit which accumulates. It is apparent from these prior documents that where it is proposed that the essential part of the combustion process takes place in a flame box, the walls of which are not cooled externally as in the case of conventional combustion chambers, then the proposed solutions only partly fulfill their objective, because the walls are cooled from the inside by the effect of the turbulent flow of the oxygen-containing gas mixture.

In the case of U.S. Pat. Nos. 2,606,604 and 3,319,692 air is fed into the flame box without turbulence. U.S. Pat. No. 2,606,604 uses a succession of perforated deflectors disposed transversely to the flame box axis to retain the combustible mixture so that the heat arising from its combustion reheats the mixture as it is introduced, so improving combustion. However, no explanation is given regarding the way in which the combustible mixture flows in the box, or consequently, on how the combustion proceeds. Finally, in U.S. Pat. No. 3,319,962 there is no special arrangement for increasing the retention time of the combustible mixture in the flame box, only a recirculation external to the flame box being induced.

It appears that none of these methods allows a satisfactory solution to the problem of burning a fluid and in particular liquid fuel with external recirculation of the exhaust gas, so that the combustion is complete and stable while operating with only a very small excess of air.

The object of the present invention is to at least partly obviate the aforesaid drawbacks.

To this end, the invention provides a combustion head for a combustion chamber, comprising an injection nozzle for a fluid fuel, particularly a liquid fuel, connected to a pressurized source of said fuel, and a gas-feed conduit connected to a pressurized source of oxygen, the downstream end of which conduit opens into a combustion space of generally cylindrical shape, by way of an aperture designed to create a substantial pressure drop, a disc being mounted at the outlet of the box and being dimensioned to create a second, lower, pressure drop, the combustion space being dimensioned to avoid the formation of a toroidal vortex therein.

More specifically, the communication aperture between the gas-feed conduit and the combustion space is dimensioned to create a pressure drop of between 75 and 150 mm water gauge during the passage of said gas, the diameter of the combustion space is between 2 and 6 times the diameter of said apeture, the disc is disposed at the outlet of said combustion space at a distance of 3.5 to 5.5 times the diameter of said aperture, and the diameter of the disc is chosen to create a pressure drop of between 15 and 50 mm water gauge at the outlet of said combustion space.

BRIEF DESCRIPTION OF THE DRAWING

The single FIGURE of the accompanying drawing shows by way of example an axial section through a combustion head according to the invention, mounted at the inlet of a combustion chamber.

SPECIFIC DESCRIPTION

The combustion head illustrated is provided with all the components of a burner, including a fuel-injection nozzle 1 disposed coaxially in a feed conduit 2 for a mixture of air and recirculated combustion gas. The conduit 2 constitutes the outlet of a spiral chamber 3, fixed to the cover 4 of a combustion chamber 5, and terminates in said combustion chamber by way of a cylindrical box constituting the combustion head proper, of which further details will be given hereinafter.

An annular fixed blade system 7 forming a swirl generator can be disposed at the outlet of the spiral chamber 3. The inclination of the blades of this blade system is such as to impress on the oxygen-containing gas mixture fed into the combustion chamber 5 a slight helical or swirl movement which is defined by a swirl number $G_\phi/r \cdot G_x$ given by the ratio of the flow in terms of the kinetic moment $G_\phi$, communicated to the gas, to the product of the radius r of the burner distribution aperture and the flow in terms of the quantitative axial flow $G_x$. This number is preferably chosen to be less than 0.2, and in any case less than the threshold above which a toroidal vortex is created in the box 6 by the swirl effect.

Alternatively, the oxygen-containing gas mixture can be fed into the cylindrical box 6 without any helical movement.

In a modification shown by dashed and dotted lines, the conduit 2 leading from the blade system 7 to the nozzle 1 is divided into two coaxial annular parts 2*a*, 2*b* by a partition 9, and the blades 7 on one side and the other of this partition 9 can be inclined respectively in opposite directions to each other so as to form respective swirl generators producing two flows which have helical movements in opposite directions, and which mix as they are injected into the box 6. These two helical movements tend to cancel each other out as they mix. By this means, it is possible to substantially exceed the previously indicated swirl number of 0.2 for each of the flows, but the total swirl number must then not exceed about 0.2 to 0.3, to avoid the formation of a toroidal vortex. The two gas flows may have different swirl numbers. This modification has the advantage that it creates an additional mixing on combining the two flows.

The box 6 in which the major part of the combustion is carried out comprises an inlet aperture 6*a* and an annular outlet aperture 6*b* provided around a disc 6*c* which is fixed concentrically to the cylindrical box 6 by radial arms 6*d*.

The dimensions of the various components of the cylindrical box 6 are important in obtaining combustion practically free from soot and CO when operating with an air excess of 5 to 15% and an exhaust-gas recirculation of about 50%, and they are also important in obtaining stable combustion, in preventing any coke deposition, and in obtaining easy ignition. To this end, the oxygen-containing gas fed into the cylindrical box 6 must have a high speed in order to produce the high turbulence level necessary to give intense combustion. Tests have shown that the diameter of the aperture 6*a* should be of such a size as to give a pressure drop of 75 to 150 mm water gauge. Below this range combustion is poor, and above this range ignition is difficult.

The box 6 can be dimensioned starting from the diameter of the aperture 6*a*. Its axial length should be between 3.5 and 5.5 times this diameter. This length is in fact chosen to be such that the central core I of the gas stream introduced into the box 6 does not touch the disc 6*c*. The length of this central core is of the order of 4 to 5 times the diameter of the aperture 6*a*, according to the amount of swirl. If the disc 6*c* is too close to the aperture 6*a*, the core I of the injected cold gas comes into contact with this disc and then extends radially towards the outside of it, thus cooling it. On the other hand, if the disc 6*c* is placed too far from the aperture 6*a*, the flame becomes unstable. When the disc is in its optimum position, the flame is stable and the disc is so hot that formation of carbon or coke deposits is prevented.

The disc 6*c* does not have to be placed at the end of the box 6. It could be placed either slightly inside or slightly outside the box 6, according to the shape which it is required to give to the flame leaving the box 6 through the annular aperture 6*b*.

The size of this annular aperture 6*b* is chosen so as to induce a recirculation V behind, i.e. downstream, of the disc 6*c* in order to ensure combustion of the residual fuel and to keep CO levels as low as possible. For this purpose, the diameter of the disc 6*c* is chosen so that the annular aperture gives rise to a pressure drop of the order of 15 to 30 mm water gauge.

The diameter of the cylindrical portion of the box 6 is between 2 and 6 times the diameter of the aperture 6*a*.

The drawing shows the various flow streams in the cylindrical box 6 and at the box outlet. The included angle of the fuel atomization cone II preferably lies between 60° and 95°. As can be seen, a recirculation III is formed about a divergent turbulent zone IV surrounding the central core I of the air jet. This recirculation III enables the wall of the cylindrical box 6 to be heated to a temperature of 600° to 800° C., at which the box becomes red hot, this temperature exceeding the final temperature of the distillation curve for a light fuel, so that no deposit can be produced by coke accumulation. A further effect of the annular recirculation III is to bring the products of combustion to the base of the air jet leaving the orifice 6*a*, thereby improving the flame stability.

It should be noted that this toroidal-vortex recirculation III has a direction of rotation, indicated by arrows, which is contrary to the direction of rotation which would be induced by an intense swirl. This direction of rotation is important because, in the case of the jet, the direction of rotation induced causes a recirculation of the hot combustion gas which heats the wall of the box 6. In contrast, in the case of a toroidal vortex induced by a swirl, the direction of rotation would be opposite to that shown, thus guiding the cold gas leaving the aperture 6*a* against the wall of the box 6, and thereby leading to the formation of carbon and coke deposits.

We claim:

1. A combustion head for a combustion chamber, comprising a fuel-injection nozzle, a feed conduit for a pressurized oxygen-containing gas, a combustion space of generally cylindrical shape into which the outlet end of said feed conduit opens by way of a communication aperture dimensioned to create a pressure drop of between 75 and 150 mm water gauge during the passage of said gas, the diameter of said combustion space being between 2 and 6 times the diameter of said aperture, and a disc disposed at the outlet of said combustion space at an axial distance from the aperture of 3.5 to 5.5 times the diameter of said aperture, the diameter of said disc being such as to create a pressure drop of between 15 and 50 mm water gauge at the outlet of said combustion space.

2. A combustion head as claimed in claim 1, wherein a swirl generator is provided in said feed conduit, said swirl generator being so arranged that the swirl produced is less than the threshold beyond which a toroidal vortex would be created in said combustion space by the effect of the helical flow of said gas.

3. A combustion head as claimed in claim 1, wherein said feed conduit is divided into coaxial annular parts, each provided with a swirl generator for respectively swirls having a different swirl number and/or direction, such that the total swirl number is less than the threshold beyond which a toroidal vortex would be created in said combustion space by the effect of the helical flow of said gas.

* * * * *